US006293342B1

(12) United States Patent
McGarian et al.

(10) Patent No.: US 6,293,342 B1
(45) Date of Patent: Sep. 25, 2001

(54) BYPASS VALVE CLOSING MEANS

(75) Inventors: Bruce McGarian; Rory McCrae Tulloch, both of Aberdeen (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/463,460

(22) PCT Filed: Jul. 28, 1998

(86) PCT No.: PCT/GB98/02244

§ 371 Date: Jan. 27, 2000

§ 102(e) Date: Jan. 27, 2000

(87) PCT Pub. No.: WO99/05393

PCT Pub. Date: Feb. 4, 1999

(30) Foreign Application Priority Data

Jul. 28, 1997 (GB) ..... 9715930
Jul. 29, 1997 (GB) ..... 9716011

(51) Int. Cl.[7] ..... E21B 34/10
(52) U.S. Cl. ..... 166/317; 166/319; 166/323
(58) Field of Search ..... 317/319, 323

(56) References Cited

U.S. PATENT DOCUMENTS 2,251,977 * 8/1941 Burt ..... 166/156
3,381,756 * 5/1968 Reagan ..... 166/319
3,794,112 2/1974 Hill ..... 166/64
3,830,297 8/1974 Cockrell .
4,423,782 1/1984 Bowyer ..... 166/321
4,576,235 * 3/1986 Slaughter et al. ..... 166/374
4,662,486 5/1987 Stenberg ..... 188/312
5,040,606 8/1991 Hopper ..... 166/332
5,261,486 11/1993 Cornette et al. ..... 166/51
5,465,787 * 11/1995 Roth ..... 166/66.4
6,003,834 * 12/1999 Read ..... 251/30.01

FOREIGN PATENT DOCUMENTS 2 307 932 6/1997 (GB) .

* cited by examiner

*Primary Examiner*—Hoang Dang
(74) *Attorney, Agent, or Firm*—Dykema Gossett PLLC

(57) ABSTRACT

This invention relates particularly but not exclusively to the secondary means for closing a bypass valve. A bypass valve (102) is provided which comprises a body (4) having a bore extending therethrough; at least one aperture (32) adapted to allow fluid communication between the bore and a chamber defined in the body (4); and at least one aperture adapted to allow fluid communication between the chamber and the exterior of the bypass valve. Fluid communication between the chamber and the bypass valve exterior is permitted when a piston (78) located in the chamber is in a first position, but is not permitted when the piston (78) is in a second position. Mechanism for selectively exposing the piston (78) to a pressure differential which moves the piston (78) is provided. A bypass valve is hereby provided which is more reliable than conventional bypass valve equipment.

21 Claims, 6 Drawing Sheets

BYPASS VALVE CLOSING MEANS

BACKGROUND OF THE INVENTION

1. Field of the Invention

This invention relates to bypass valves for use in wellbores, particularly but not exclusively to the secondary means for closing a bypass valve in the event that the primary means for closing the bypass valve fails to operate.

2. The Prior Art

It is common practice in the oil and gas drilling industry to incorporate a bypass valve in a drill string between a MWD (Measurement While Drilling) tool and a hydraulic anchor packer so that wellbore fluid may be pumped down the drill string to operate the MWD tool without prematurely setting the anchor packer. A conventional bypass valve typically incorporates a piston which slides within a cylinder in response to dynamic fluid pressure. The wall of the cylinder is provided with a plurality of holes which allows fluid to pass from the drill string bore to the wellbore annulus. The piston is held in an open position by biassing means (such as a spring or a shear pin) and thereby allows wellbore fluid to operate a MWD tool located uphole of the bypass valve whilst preventing the generation of a pressure differential between the interior and exterior of the drill string sufficient to set an anchor packer. When the setting of the anchor packer is required, the flow of wellbore fluid down the drill string is increased so as to generate a dynamic pressure sufficient to overcome the biassing means. The piston then slides within the cylinder to a closed position in which the holes are sealed. A cross-sectional side view of this type of bypass valve is shown in FIG. 1.

Conventional bypass valves can occasionally fail to move to the closed configuration when the appropriate fluid pressure is applied and this will often lead to costly and time consuming delays in a given downhole operation. In an attempt to overcome this problem, a "sliding piston" type of bypass valve (such as the one described above) has been developed with a secondary closing means in addition to the primary closing means (the sliding piston). A cross-sectional side view of this improved bypass valve is shown in FIG. 2. In the event that the primary piston within the cylinder fails to move to the closed position in response to an increase in dynamic pressure, the static pressure of the wellbore fluid in the annulus may be increased by a pump located at the surface, with the internal bore of the drill string having been sealed off, so as to generate a sufficient pressure above the downhole hydrostatic pressure to rupture a burst disc provided in the bypass valve casing. A pressure differential is thereby applied across the length of a second piston and acts to press the second piston into a closed position. The location of the second piston in the closed position is such that the holes in the wall of the cylinder are sealed. Thus, although the primary closing means may fail to operate correctly, the bypass valve can nevertheless be moved into a closed configuration by the operation of the secondary closing means.

SUMMARY OF THE INVENTION

A first aspect of the present invention provides a bypass valve for selectively isolating the interior of a downhole assembly from the exterior thereof, the bypass valve comprising: a body having a bore adapted to allow the passage of wellbore fluid therethrough; a chamber defined in the body; at least one aperture provided in the body adapted to allow fluid communication between the bore and the chamber; at least one aperture provided in the body adapted to allow fluid communication between the chamber and the exterior of the bypass valve; a piston slidably mounted in the chamber and movable between a first position in which fluid communication between the bore and the exterior of the bypass valve by means of the apertures is permitted and a second position in which fluid communication between the bore and the exterior of the bypass valve by means of the apertures is prevented, the piston being movable from the first position to the second position in response to a first predetermined fluid pressure differential; means for selectively exposing the piston to the first predetermined fluid pressure differential; and a cavity defined between the piston and the body such that the cavity changes volume when the piston moves from the first to the second position, wherein the cavity is sealed by sealing means comprising a one-way seal adapted to allow the passage therepast of fluid from the cavity in a first direction but adapted to prevent the passage therepast of fluid in a direction opposite to the first direction.

The bypass valve of the present invention may be closed by exposing the piston to the first predetermined fluid pressure differential and thereby moving the piston from the first position to the second position. In so doing, there is a change in the volume of the cavity defined between the piston and the body. This variation in cavity volume results in fluid attempting to flow past the sealing means provided to seal the interfaces between the piston and the body of the bypass valve. The one-way seal of the sealing means permits this flow of fluid in circumstances where the cavity air pressure is greater than the wellbore fluid pressure. However, a flow of fluid in the opposite direction is not permitted by the one-way seal and a pressure differential across the length of the piston may be thereby maintained so as to lock the bypass valve in the closed configuration. Whilst the bypass valve is located downhole, the cavity air pressure is unlikely to be greater than the wellbore fluid pressure when the piston is in either the first (open) or second (closed) position, and consequently, the air within the cavity is unlikely to flow past the one-way seal during the downhole operation of the bypass valve. However, as the bypass valve is tripped out of hole, the wellbore fluid pressure will drop below the pressure of the cavity air in circumstances where the piston is located in the second (closed) position. Cavity air will then flow from the cavity past the one-way seal. This facility for allowing air to flow from the cavity provides the bypass valve of the present invention with a pressure relief safety mechanism and can assist in ensuring that the piston remains in the second (closed) position once activated.

Preferably, the means for selectively exposing the piston to the first predetermined pressure differential comprises a passage defined in the body and extending between an opening on the exterior of the body and an opening in the chamber, said opening in the chamber being located adjacent the end of the piston distal to the fluid path extending through the apertures and between the bore and the exterior of the bypass valve, and said-passage being sealed by means of a burst disc. It is preferable for the burst disc to rupture at a second predetermined fluid pressure differential having a magnitude greater than that of the first fluid pressure differential. Furthermore, the chamber and piston may have an annular shape. A spring may also be provided to bias the piston towards the second position. Also, the cavity defined between the piston and the body is preferably filled with air. It is also desirable for the portion of the passage extending between the chamber and the burst disc to be filled with air. The air in the cavity and said portion of the passage is preferably at approximately atmospheric pressure. It is also desirable for the bypass valve to incorporate a second piston slidably mounted in the bore and moveable between a first position in which fluid communication between the bore and the exterior of the bypass valve by means of the apertures is permitted and a second position in which fluid communication between the bore and the exterior of the bypass valve by means of the apertures is prevented.

A second aspect of the present invention provides a bypass valve for selectively isolating the interior of a downhole assembly from the exterior thereof, the bypass valve comprising: a body having a bore adapted to allow the passage of wellbore fluid therethrough; a chamber defined in the body; at least one aperture provided in the body adapted to allow fluid communication between the bore and the chamber; at least one aperture provided in the body adapted to allow fluid communication between the chamber and the exterior of the bypass valve; and a piston slidably mounted in the chamber and movable between a first position in which fluid communication between the bore and the exterior of the bypass valve by means of the apertures is permitted and a second position in which fluid communication between the bore and the exterior of the bypass valve by means of the apertures is prevented, the piston being movable from the first position to the second position in response to a first predetermined fluid pressure differential, wherein the bypass valve further comprises means for maintaining fluid communication between the piston and the exterior of the body incorporating a passage defined in the body and extending between an opening on the exterior of the body and an opening in the chamber, said opening in the chamber being located adjacent the end of the piston distal to the fluid path extending through the apertures and between the bore and the exterior of the bypass valve; and retaining means for selectively retaining the piston in the first position.

The retaining means is preferably a shear pin extending between the piston and the body. Furthermore, the chamber and piston may have an annular shape. A spring may also be provided to bias the piston towards the second position. It is also desirable for the bypass valve to incorporate a second piston slidably mounted in the bore and movable between a first position in which fluid communication between the bore and the exterior of the bypass valve by means of the apertures is permitted and a second position in which fluid communication between the bore and the exterior of the bypass valve by means of the apertures is prevented.

A third aspect of the present invention provides a bypass valve for selectively isolating the interior of a downhole assembly from the exterior thereof, the bypass valve comprising: a body having a bore adapted to allow the passage of wellbore fluid therethrough; a chamber defined in the body; at least one internal aperture provided in the body adapted to allow fluid communication between the bore and the chamber; at least one external aperture provided in the body adapted to allow fluid communication between the chamber and the exterior of the bypass valve; and a piston slidably mounted in the chamber and movable between a first position in which fluid communication between the bore and the exterior of the bypass valve by means of the apertures is permitted and a second position in which fluid communication between the bore and the exterior of the bypass valve by means of the apertures is prevented, the piston being movable from the first position to the second position in response to a -first predetermined fluid pressure differential, wherein the or each internal aperture is located at the opposite end of the piston to the or each external aperture; the piston comprises a passage providing fluid communication between the internal and external apertures; and retaining means is provided for selectively retaining the piston in the first position.

The piston is preferably movable from the first position in a direction opposite to that in which the piston moves when moving from the first position to the second position. The retaining means is preferably a shear pin extending between the piston and the body. Furthermore, the chamber and piston may have an annular shape. A spring may also be provided to bias the piston towards the second position. It is also desirable for the bypass valve to incorporate a second piston slidably mounted in the bore and movable between a first position in which fluid communication between the bore and the exterior of the bypass valve by means of the apertures is permitted and a second position in which fluid communication between the bore and the exterior of the bypass valve by means of the apertures is prevented.

BRIEF DESCRIPTION OF THE DRAWINGS

Embodiments of the present invention will now be described with reference to the accompanying drawings, in which.

DETAILED DESCRIPTION OF THE PREFERRED EMBODIMENTS

Figure 1:
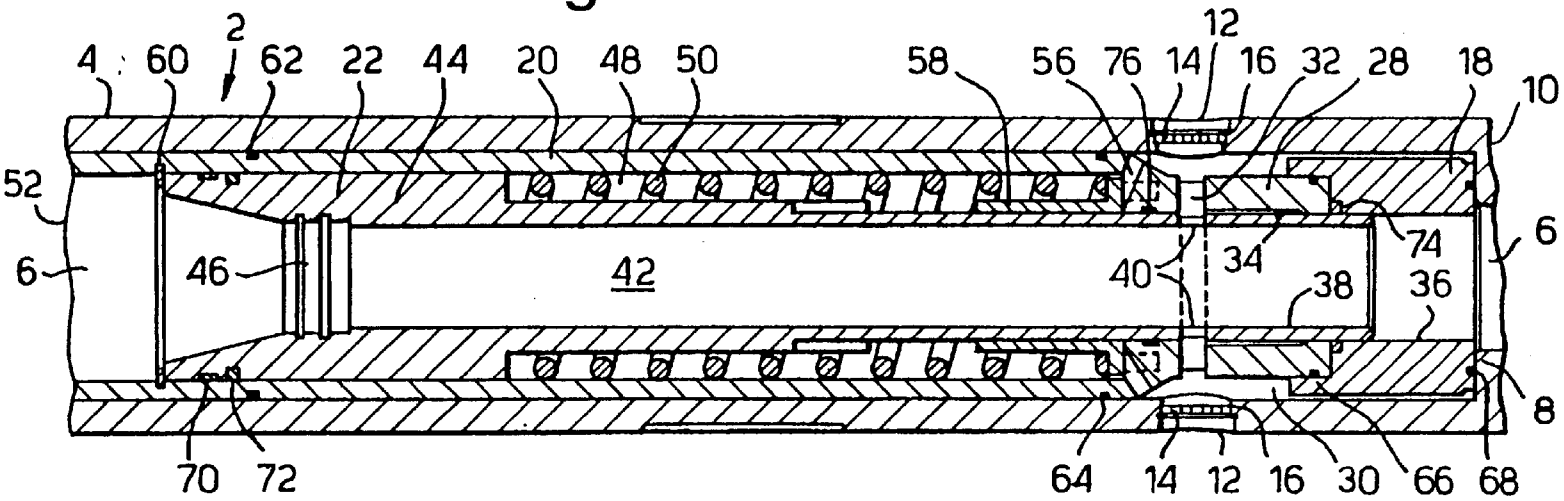
Fig.1. PRIOR ART
FIG. 1 is a cross-sectional side view of a prior art bypass valve.
Figure 2:
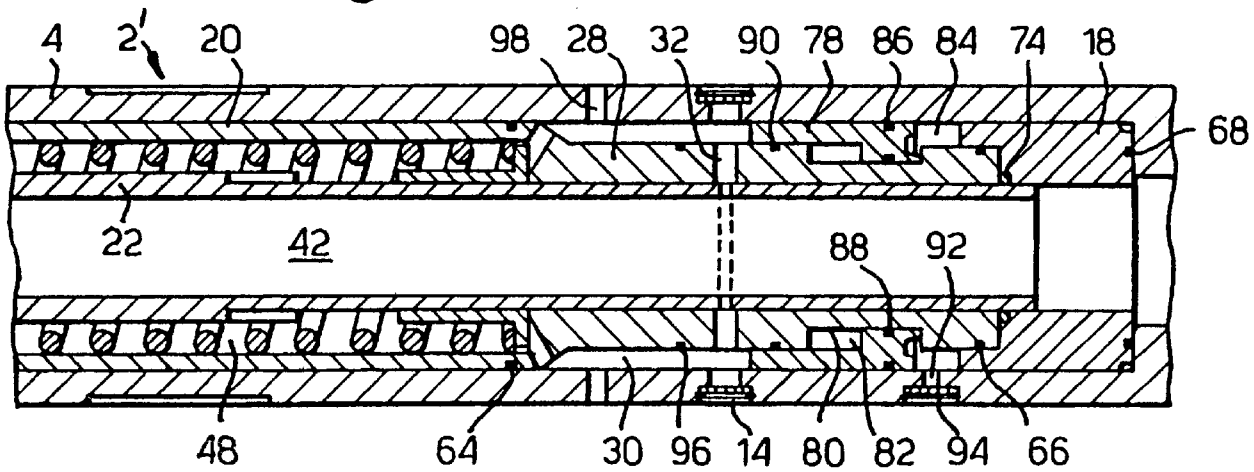
Fig.2. PRIOR ART
FIG. 2 is a cross-sectional side view of a prior art bypass valve incorporating secondary closing means.

The embodiments of the present invention will be described as improvements to the prior art bypass valves of FIGS. 1 and 2. The bypass valve of FIG. 1 is a conventional "sliding piston" bypass valve incorporating primary closing means only. The bypass valve of FIG. 2 is similar to that of FIG. 1, modified so as to incorporated secondary closing means in the form of an annular piston. These two prior art bypass valves are described in detail below.

The apparatus of FIG. 1 is a conventional bypass valve 2 comprising a plurality of internal parts mounted within the bore 6 of a casing 4. A shoulder 8 is provided in the bore 6 so as to prevent undesirable axial movement of the internal parts towards the lower end 10 of the bypass valve. Four vent holes 12 are located in the casing 4 uphole of the shoulder 8 and arranged so as to be coplanar and equispaced about the circumference of the casing bore 6. The vent holes 12 allow fluid to either enter the bypass valve from the wellbore annulus or enter the wellbore annulus from the bypass valve. Each vent hole 12 is provided with a filter disc 14 held in position by means of a filter disc circlip 16.

The plurality of internal parts includes a seal housing 18, a sleeve 20 and a piston 22. The seal housing 18 is substantially cylindrical in shape and has an outer diameter similar to the diameter of the casing bore 6 defined by the portion of the casing 4 uphole of the shoulder 8. The seal housing 18 is located downhole of the vent holes 12 and is arranged so as to abut the shoulder 8.

The sleeve 20 is also substantially cylindrical in shape, the upper end thereof having an outer diameter similar to that of the casing bore 6. The lower end 28 of the sleeve 20 has an outer diameter which is less than that of the seal housing 18. The sleeve 20 is arranged within the casing 4 with the lower end 28 of the sleeve 20 located in abutment with the seal housing 18. A vent chamber 30 in fluid communication with the vent holes 12 is thereby defined by the lower end 28 of the sleeve 20, the seal housing 18 and the casing 4. The vent chamber 30 defines an annular shape and is in fluid communication with a plurality of vent chamber ports 32. The vent chamber ports 32 are provided in the form of slots located in a recess 34 defined in the sleeve lower end 28.

The piston 22 is located in abutment with the inner surface 36 of the seal housing 18. The arrangement is such that the piston 22 may rotate and move axially within the sleeve 20 and the seal housing 18. The lower end 38 of the piston 22 extends beyond the vent chamber ports 32 and is provided with a plurality of piston holes 40 in the form of elongated slots. The piston holes 40 allow wellbore fluid to pass from the vent chamber 30 to a piston bore 42 defined. by the piston 22. The upper end 44 of the piston 22 is provided with connecting means 46 which allow the attachment of an appropriate nozzle (not shown) to the piston 22 so as to effectively reduce the diameter of the piston bore 42. The attachment of a nozzle to the piston 22 reduces the flow rate of wellbore fluid required to move the piston 22 axially within the sleeve 20. The flow rate at which the bypass valve closes may therefore be varied with the inclusion of a suitable nozzle.

The piston 22 and the sleeve 20 define a piston spring chamber 48 in which a piston spring 50 is located. The piston spring 50 presses against the lower end 28 of the sleeve 20 and the upper end 44 of the piston 22, and thereby biases the piston 22 towards the upper end 52 of the bypass valve. Axial movement of the piston 22 is assisted by the venting of the piston spring chamber 48 to the vent chamber 30 by means of piston spring chamber ports 56 located in the sleeve lower end 28. The axial movement of the piston 22 is restricted by a piston stop 58 and a piston circlip 60.

The sleeve 20 extends uphole of the piston 22 so as to abut a cross-over member (not shown) to which the casing 4 is threadedly connected. O-ring seals 62,64,66,68 are provided in order to prevent undesirable ingress of wellbore fluid. Glyd ring seals 72,74, are also provided to seal the interfaces of the piston 22 and to assist with the movement of the piston 22 within the sleeve 20 and the seal housing 18. Slyd rings 70,76 are further provided as a bearing surface for the piston 22.

The components of the bypass valve 2 are manufactured from a suitable grade of steel; however, alternative materials will be apparent to a reader skilled in the art.

In use, the bypass valve 2 is run into a wellbore whilst arranged in an open configuration (i.e. with the piston 22 biased towards the upper end 52 of the bypass valve so that the piston holes 40 are substantially in line with the vent chamber ports 32) and thereby allows wellbore fluid to enter the drill string through the vent holes 12. Debris is prevented from entering the drill string by means of the filter discs 14. The flow of wellbore fluid into the bypass valve equalises the very high hydrostatic pressures exerted on the outer surface of the drill string.

The wellbore fluid held within the drill string is circulated down the drill string bore at a predetermined flow rate sufficient for the operation of a MWD tool, but not high enough to generate the dynamic pressure required to activate the bypass valve. The wellbore fluid flows from the surface, through the MWD tool, into the wellbore annulus via the vent holes 12, and back to the surface through the annulus. Hydraulic anchor packers located downhole of the bypass valve 2 are not thereby exposed to a setting pressure differential.

Once the required position and orientation of the drill string within the wellbore has been obtained (measured with the MWD tool), the hydraulic anchor packers are set by moving the bypass valve into a closed configuration. In the closed configuration, the piston holes 40 are located downhole of the glyd ring seal 74 provided between the seal housing 18 and the lower end 38 of the piston 22, and the flow of wellbore fluid between the piston bore 42 and the wellbore annulus is thereby prevented. The movement of the bypass valve into the closed configuration is simply achieved by increasing the flow rate of wellbore fluid down the drill string and out through the vent chamber ports 32 so that sufficient dynamic pressure is generated across the length of the piston 22 to overcome the biasing force of the piston spring 50. Once the piston 22 sealingly closes the vent chamber ports 32, the required setting pressure differential at the anchor packers is generated. This results in a large pressure rise at the surface indicating that the anchor packers have been set.

As already discussed above, the piston 22 can become jammed, possibly due to the accumulation of debris suspended in the wellbore fluid, and thereby fail to close the bypass valve 2 when the dynamic pressure required to overcome the piston spring 50 is applied. The bypass valve 2 must be then withdrawn from the wellbore leading to expenses and time consuming delays. However, in an attempt to overcome this problem, the bypass valve 2 has been modified as shown in FIG. 2.

The bypass valve of FIG. 2 differs from the bypass valve of FIG. 1 in that secondary closing means is provided. The lower end 28 of the sleeve 20 is extended to form an elongated vent chamber 30 which receives an annular piston 78 located downhole of the vent chamber ports 32. Furthermore, a recess 80 is provided in the lower end 28 of the sleeve 20 so as to define a first cavity 82 between the sleeve lower end 28 and the annular piston 78. A second cavity 84 is also defined downhole of the annular piston 78 between the annular piston 78, the casing 4, the seal housing 18 and the sleeve lower end 28. Both the first and second cavities 82,84 are filled with air and sealed by means of O-ring seals 66,68,86,88,90. A passage 92 extending between the second cavity 84 and the exterior of the bypass valve 2 is also provided in the casing 4, and is sealed by means of a burst disc 94 located therein. The air within the cavities 82,84 is at a pressure slightly above the ambient atmospheric pressure at the time of assembly. This is due to the compression of the air in each cavity 82,84 as the final seal is pressed into position. A further O-ring seal 96 is provided in the lower end 28 of the sleeve 20 uphole of the vent chamber ports 32. Secondary chamber ports 98 are also provided in the casing 4 so as to assist in the venting of the piston spring chamber 48.

When in use, the bypass valve 2' is run downhole with the piston 22 of the primary closing means and the annular piston 78 of the secondary closing means located in the open positions shown in FIG. 2. With the primary piston 22 and the annular piston 78 located in these positions, wellbore fluid may drain into the piston bore 42 via the vent chamber ports 32. The bypass valve 2' may be closed by means of the primary piston 22 as described above with respect to the bypass valve 2 of FIG. 1. However, unlike the bypass valve 2, the bypass valve 2' may also be closed without use of the primary piston 22.

If a flow of wellbore fluid down the drill string fails to close the bypass valve 2' by means of the primary piston 22, then the annulus may be statically pressurized with the drill string bore sealed off at the surface. In so doing, a static hydraulic pressure differential across the burst disc 94 is generated having a value above the ambient downhole hydrostatic pressure differential and this is increased until a predetermined level is attained. The burst disc 94 then ruptures and the air within the second cavity 84 escapes through the passage 92 allowing wellbore fluid to contact the lower end of the annular piston 78. Due to the geometry of the annular piston 78 and the provision of the O-ring seals 86,88,90 adjacent the annular piston 78, a hydraulic pressure differential is then created across the length of the annular piston 78 which applies a resultant force on the annular piston 78 acting in an uphole direction. This force is sufficient to move the annular piston 78 uphole within the recess 80. The geometry of the secondary closing means is such that the annular piston 78 moves to a closed position in which the upper end thereof extends between the O-ring seals 90,96 located either side of the vent chamber ports 32. The vent chamber ports 32 are thereby scaled. Once in the closed position, the annular piston 78 becomes hydraulically locked and will remain in the closed position until the bypass valve is tripped uphole to the point where the internal air pressure in the first cavity 82 is greater than the ambient hydrostatic pressure and the annular piston is thereby pushed back downhole.

The predetermined pressure differential at which the burst disc 94 should rupture depends upon the depth of the downhole operation in question. By way of example, the hydrostatic pressure at 5000 feet or 1524 m TVD (True Vertical Depth) is 3100 psi or 21.4 MPa (assuming a mud density of 12 lb/gal. or 1197 kg/m$^3$ (Sg 1.44)). A bypass valve to be operated at 5000 feet (1524 m) TVD would therefore require a burst disc designed to rupture at a pressure differential of at least 3100 psi (21.4 MPa). However, in practice, it would be preferable to select a burst disc designed to rupture above this value so as to allow for material variations and true vertical depth inaccuracy. A burst disc selected to rupture above the ambient downhole hydrostatic pressure will also prevent the bypass valve from being closed prematurely. Typically, a pressure of 500 psi or 3.4 MPa above ambient downhole hydrostatic pressure will be acceptable and therefore, in the present example, this would lead to the selection of a burst disc having a rating of approximately 3600 psi or 24.8 MPa. Furthermore, the rating of the burst disc is limited by the casing strength in circumstances where the lower end of the wellbore is plugged and the casing is not cemented up on its outer surface, or by the danger of driving mud into the information in circumstances where the wellbore is unplugged. The collapse pressure of the work string must also be considered when selecting a suitable burst disc.

Figure 3:
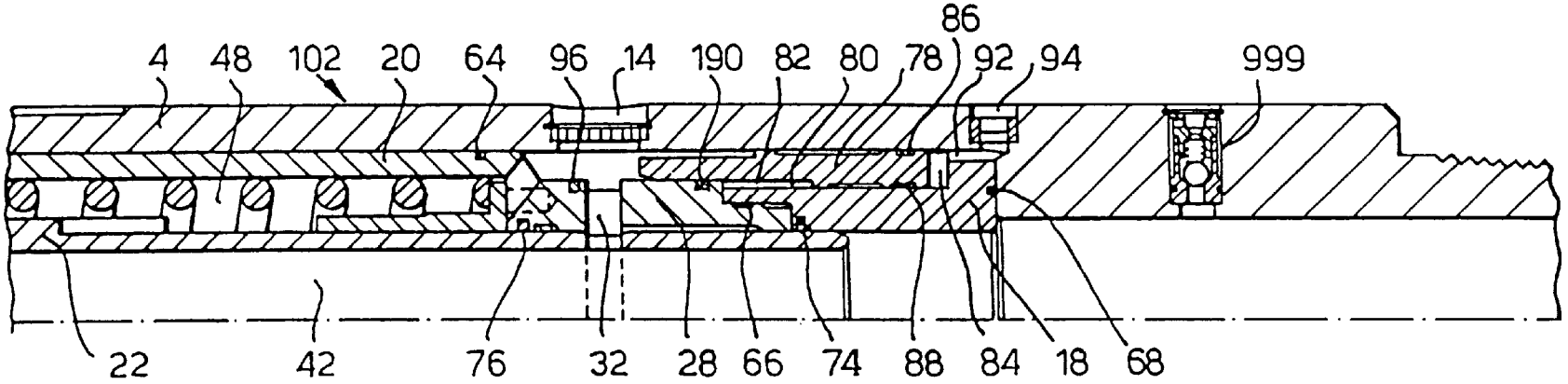
FIG. 3 is a cross-sectional side view of a first embodiment of the present invention with secondary closing means arranged in an open position.
Figure 4:
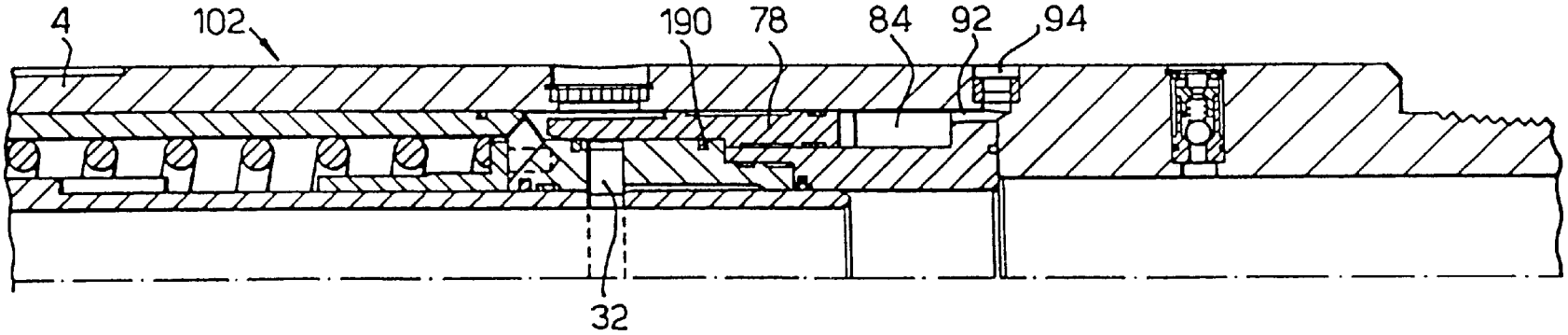
FIG. 4 is a cross-sectional side view of the first embodiment of FIG. 3 with the secondary closing means arranged in a closed position.

The present invention offers a number of advantages over the prior art bypass valve 2' described above and a first embodiment is shown in FIGS. 3 and 4. The bypass valve 102 shown in these figures has a substantially similar arrangement to the prior art bypass valve 2' shown in FIG. 2 and those components of bypass valve 102 which correspond to components of the prior art bypass valves have been labelled with the reference numerals used in FIGS. 1 and 2. Minor differences between the bypass valve 102 and the prior art bypass valve 2' may be seen in the arrangement of the recess 80 which is formed by the sleeve lower end 28 and the seal housing 18 rather than by the sleeve lower end 28 alone. This arrangement allows the bypass valve 102 to be assembled more readily. Furthermore, the seal housing 18 defines part of the passage 92 extending between the second cavity 84 and the exterior of the bypass valve 102. Also, the secondary chamber ports 98 provided in the prior art bypass valve 2' are omitted from the bypass valve 102 of the present invention. A check valve 999 can also be located within the casing 4 of the bypass valve 102 and is used to prevent excessive pressure surge within the casing 4 when the bypass valve 102 is closed conventionally by means of the primary piston 22. The inclusion of the check valve 999 is optional and does not affect the operation of the present invention.

A further option is the provision of a spring (not shown) downhole of the annular piston 78. The spring is arranged to bias the annular piston 78 towards the vent chamber ports 32, but does not do so with sufficient force to close or partially close the bypass valve 102 prematurely.

An improvement of the present invention over the prior art bypass valve 2' results from the provision of a one-way seal 190 provided between the sleeve lower end 28 and the annular piston 78. The one-way seal 190 replaces the conventional O-ring seal 90 used in the prior art bypass valve 2', and has the advantage of allowing air retained in the first cavity 82 to escape therefrom. Although the one-way seal 190 allows air to flow from the first cavity 82, the seal 190 nevertheless prevents wellbore fluid from flowing therepast in the opposite direction.

The annular piston 78 sealingly closes the vent chamber ports 32 when the burst disc 94 is ruptured as described above in connection with the prior art bypass valve 2'. As the annular piston 78 moves from the open position (shown in FIG. 3) to the closed position (shown in FIG. 4), the air within the first cavity 82 is compressed. Depending upon the TVD of the bypass valve 102, the cavity air pressure is unlikely to be greater than the wellbore pressure when the annular piston 78 is in either the open or closed position, and consequently, the air within the first cavity 82 is unlikely to flow past the one-way seal 190 during the downhole operation of the bypass valve. However, as the bypass valve 102 is tripped out of hole, the wellbore fluid pressure will drop below the pressure of the cavity air in circumstances where the annular piston 78 is located in the closed position. Cavity air will then flow from the first cavity 82 past the one-way seal 190. This facility for allowing air to flow from the cavity provides the bypass valve 102 of the present invention with a pressure relief safety mechanism and can assist in ensuring that the annular piston 78 remains in the closed position once activated. This is in contrast to the prior art bypass valve 2' which retains air within the first cavity 82. In the prior art bypass valve 2', the air within the first cavity 82 is compressed as the annular cylinder 78 moves to the closed position and thereby generates a force biasing the annular piston 78 towards the open position. This force can be undesirable in that, as the bypass valve is tripped out of hole, the annular piston 78 is moved back to the open position. The arrangement of the present invention allows air to escape from the first cavity 82 as the bypass valve 102 is tripped out of hole and thereby reduces this force so that the annular piston 78 does not move back to the open position. Inspection through the vent chamber ports 32 once the bypass valve is at the surface will then confirm that the bypass valve 102 has been closed by means of the annular piston 78.

Figure 5:
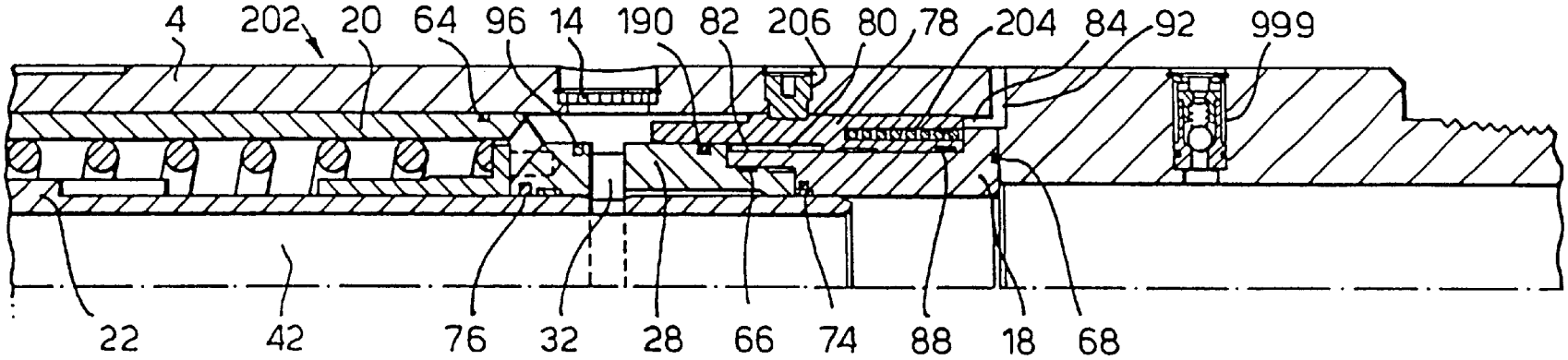
FIG. 5 is a cross-sectional side view of a second embodiment of the present invention with secondary closing means arranged in an open position.
Figure 6:
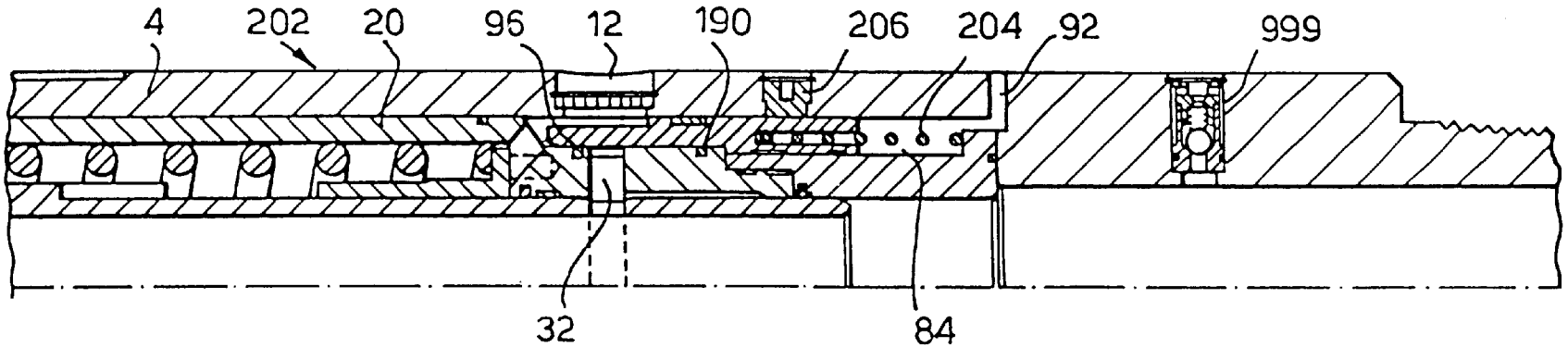
FIG. 6 is a cross-sectional side view of the second embodiment of FIG. 5 with the secondary closing means arranged in a closed position.

A second embodiment of the present invention is shown in FIGS. 5 and 6. The bypass valve 202 shown in these figures has a similar arrangement to the bypass valve 102, differing in that the O-ring seal 86 is omitted, a spring 204 is provided (optionally) to bias the annular piston 78 in an uphole direction, a shear pin 206 is provided between the casing 4 and the annular piston 78, and the burst disc 94 is omitted from the passage 92.

The absence of the burst disc 94 from the passage 92 results in the downhole end of the annular piston 78 being in permanent fluid communication with the exterior of the bypass valve 202, and consequently, the shear pin 206 serves to retain the annular piston 78 in the open position shown in FIG. 5 until a predetermined pressure differential is applied. Once exposed to this predetermined pressure differential, the annular piston 78 is pressed with sufficient force to shear the shear pin 206 and move uphole to the closed position shown in FIG. 6. This predetermined pressure differential corresponds to a hydrostatic pressure within the annulus similar to that required to rupture the burst discs 94 of the aforementioned bypass valves 2',102. It is considered that the use of a shear pin instead of a burst disc leads to a simpler and more reliable arrangement for the secondary closing means.

Figure 7:
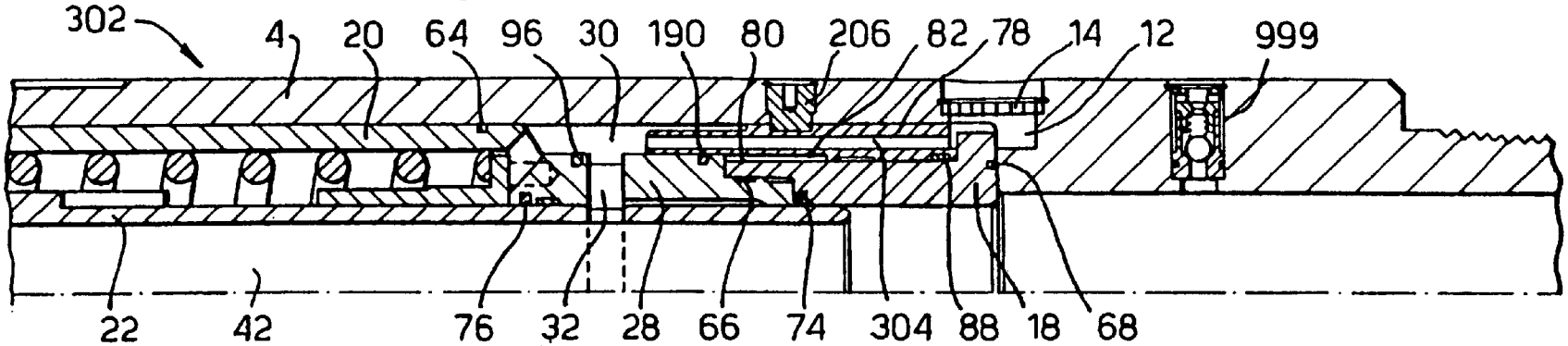
FIG. 7 is a cross-sectional side view of a third embodiment of the present invention with secondary closing means arranged in an open position.

A third embodiment of the present invention is shown in FIG. 7. The bypass valve 302 shown in this figure has a similar arrangement to the bypass valve 202 shown in FIGS. 5 and 6, differing in that the vent holes 12 are located downhole of the annular piston 78 and are combined with the passage 92, and in that the annular piston 78 is provided with a longitudinal passage 304 permitting fluid communication between the exterior of the bypass valve 302 and the vent chamber 30. The spring 204 is not provided in the third embodiment, but may be included if considered appropriate.

When in use, wellbore fluid may be pumped through the piston bore 42, through the vent chamber ports 32 and into the wellbore annulus via the annular piston passage 304 and the vent holes 12. In the event that the primary piston 22 fails to operate correctly, the bypass valve 302 may be closed by directing wellbore fluid down the annulus, through the vent holes 12 and the annular piston passage 304, and into the vent chamber 30. The resultant dynamic and hydrostatic pressure differential across the length of the annular piston 78 may be then employed to shear the shear pin 206 and move the annular piston 78 uphole into a closed position. The arrangement of this embodiment is also considered to be simpler and more reliable than that of the prior art bypass valve 2'.

Figure 8:
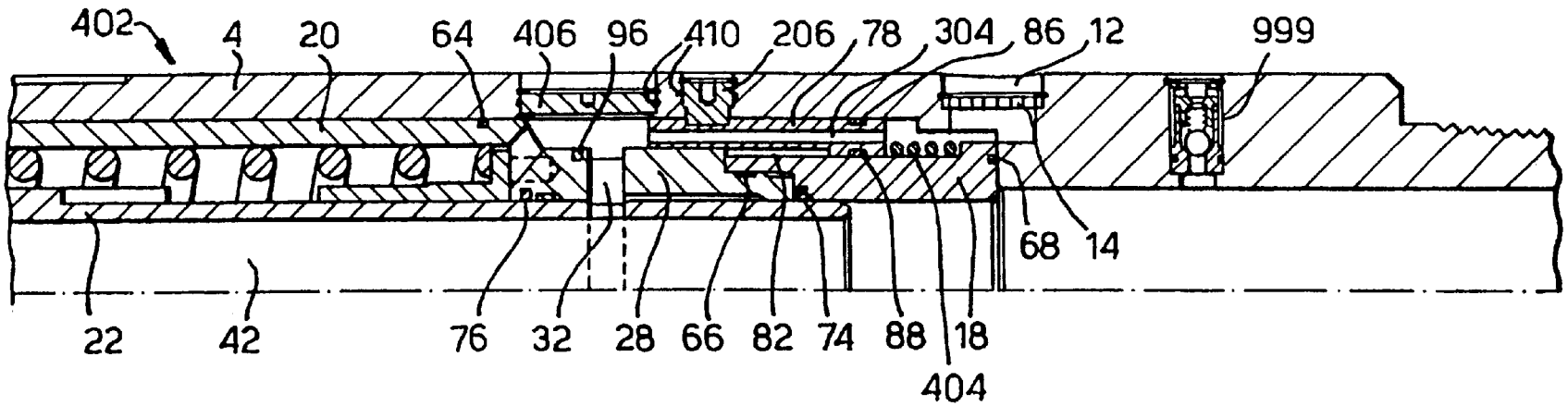
FIG. 8 is a cross-sectional side view of a fourth embodiment of the present invention with secondary closing means arranged in an open position.

A fourth embodiment of the present invention in shown in FIG. 8. The bypass valve 402 shown in this figure has a similar arrangement to the bypass valve 302, differing in that a spring 404 is provided to bias the annular piston 78 in an uphole direction, an access port 406 is provided to allow compression of the spring 404 on assembly of the bypass valve 402, and the seal 190 between the sleeve lower end 28 and the upper portion of the annular piston 78 is omitted. Furthermore, both the access port 406 and the shear pin 206 are provided with an O-ring seal 410 to prevent undesirable leakage of wellbore fluid.

Due to the absence of the one-way seal 190, the first cavity 82 is filled with wellbore fluid rather than air, and consequently, a hydrostatic pressure differential across the length of the annular piston 78 cannot be generated. The force required to move the annular piston 78 and shear the shear pin 206 is generated by the dynamic pressure differential resulting from a flow of wellbore fluid through the annular piston passage 304. This flow may be generated as described above in respect of the bypass valve 302 shown in FIG. 7. Alternatively, the shear pin 206 may be sheared by wellbore fluid flowing through the annular piston passage 304 in the opposite direction since the shear pin 206 retains the annular piston 78 in a position allowing either uphole or downhole axial movement.

It is preferable for the shear pin 206 to be designed to shear at a fluid flow rate in excess of that normally needed to move the primary piston 22. Hence, if the primary piston 22 fails to operate, then the fluid flow within the piston bore 42 may be increased to generate a dynamic pressure differential sufficient to move the annular piston 78 downhole. Once the shear pin 206 has been sheared, the fluid flow is reduced to allow the spring 404 to move the annular piston 78 uphole to the closed position. The annular piston 78 is then retained in the closed position by the bias of the spring 404. The ability of this arrangement to operate without the need to redirect fluid flow down the annulus is considered to be a significant advantage over the prior art bypass valve 2'.

Figure 9:
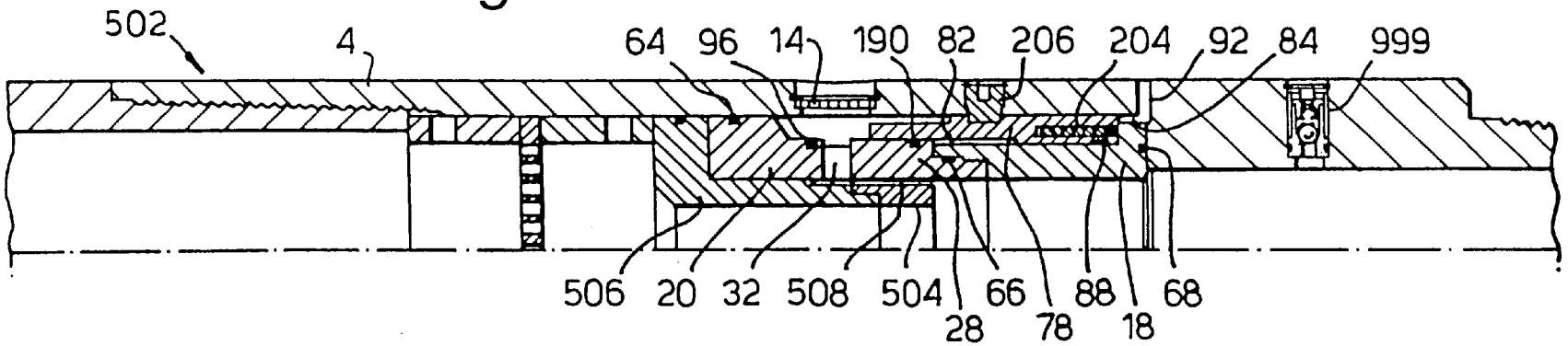
FIG. 9 is a cross-sectional side view of a fifth embodiment of the present invention with secondary closing means arranged in an open position.
Figure 10:
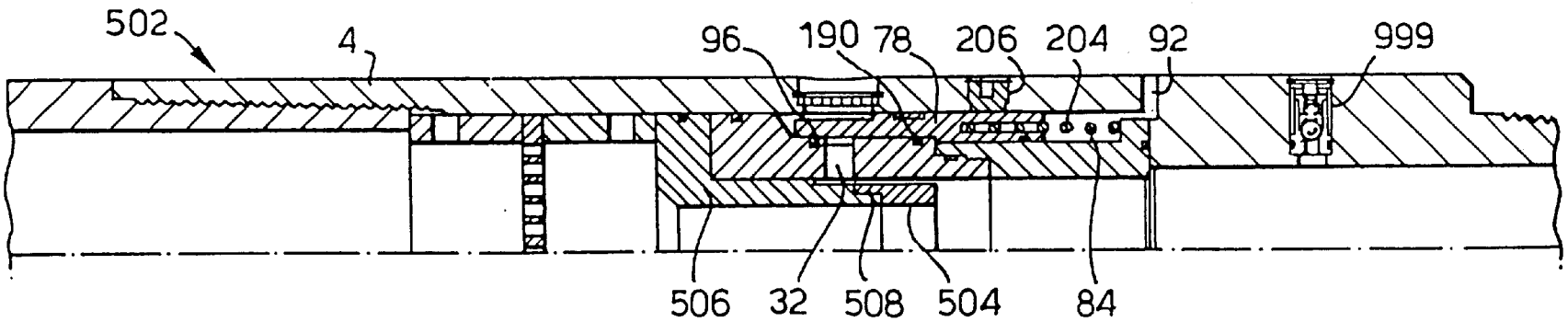
FIG. 10 is a cross-sectional side view of the fifth embodiment of FIG. 9 with the secondary closing means arranged in a closed position.

A fifth embodiment is shown in FIGS. 9 and 10. The bypass valve 502 shown in these figures incorporates secondary closing means identical to that provided in the second embodiment of the present invention. The fifth embodiment differs from the second embodiment in that the primary closing means is an elastomeric ring 504 bonded onto a steel support sleeve 506. This primary closing means is already known in the oil and gas drilling industry, and becomes activated when the rate of fluid flow through the annular gap 508 defined between the elastomeric ring 504 and the sleeve lower end 28 is sufficiently high to deform the elastomeric ring 504 into abutment with the sleeve lower end 28 and thereby seal the vent chamber ports 32. The operation of the secondary closing means is as described in relation to the bypass valve 202 shown in FIGS. 5 and 6.

Figure 11:
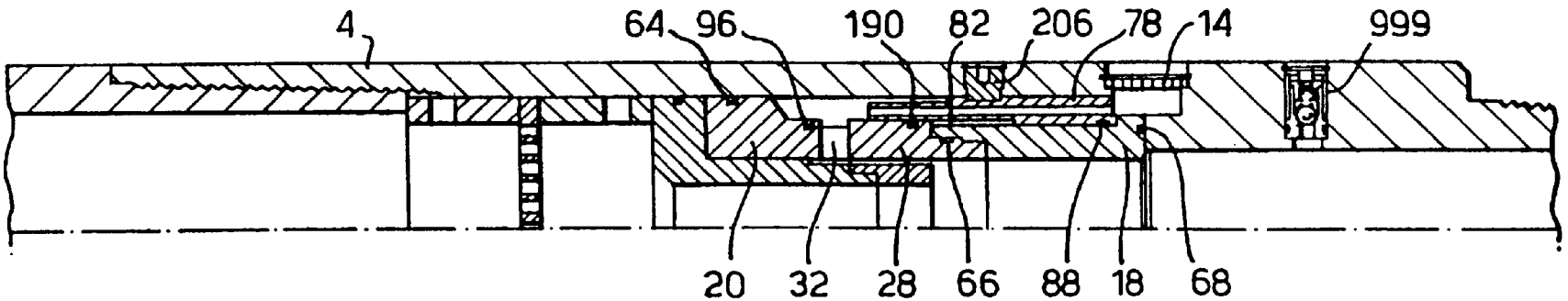
FIG. 11 is a cross-sectional side view of a sixth embodiment of the present invention with secondary closing means arranged in an open position.

A sixth embodiment is shown in FIG. 11. The bypass valve 602 shown in this figure comprises the primary closing means of the bypass valve 502 shown in FIGS. 9 and 10, and the secondary closing means of the bypass valve 302 shown in FIG. 7. The operation of these primary and secondary closing means is as described above.

Further variations will be apparent to a reader skilled in the art. For example, a bypass valve may be provided comprising the "elastomeric ring" primary closing means shown in FIGS. 9, 10 and 11, and either of the secondary closing means of the first and fourth embodiments shown in FIGS. 3, 4 and 8. Furthermore, the shear pin 206 could be replaced with one or more shear rings, or with a spring-loaded pin having a canted end face which may be cammed by the annular piston 78. A further variation would be to replace the primary closing means of any of the embodiments described above with a check valve located in the vent holes 12. Also, the secondary closing means described above may be used in a multi-cycle bypass valve such as the one described in the applicant's International Patent Application No. PCT/GB96/03027.

We claim:

1. A bypass valve for selectively isolating the interior of a downhole assembly from the exterior thereof, the bypass valve comprising: a body having a bore for allowing the passage of wellbore fluid therethrough; a chamber defined in the body; at least one aperture provided in the body for allowing fluid communication between the bore and the chamber; at least one aperture provided in the body for allowing fluid communication between the chamber and the exterior of the bypass valve; a piston slidably mounted in the chamber and movable between a first position in which fluid communication between the bore and the exterior of the bypass valve by means of the apertures is permitted and a second position in which fluid communication between the bore and the exterior of the bypass valve by means of the apertures is prevented, the piston being movable from the first position to the second position in response to a first predetermined fluid pressure differential; means for selectively exposing the piston to the first predetermined fluid pressure differential; and a cavity defined between the piston and the body such that the cavity changes volume when the piston moves from the first to the second position, wherein the cavity is sealed by sealing means comprising a one-way seal for allowing the passage therepast of fluid either from or to the cavity in a first direction as a consequence of said volume change but for preventing the passage therepast of fluid in a direction opposite to the first direction.

2. A bypass valve according to claim 1, wherein the means for selectively exposing the piston to the first predetermined pressure differential comprises a passage defined in the body and extending between an opening on the exterior of the body and an opening in the chamber, said opening in the chamber being located adjacent the end of the piston distal to the fluid path extending through the apertures and between the bore and the exterior of the bypass valve, and said passage being sealed by means of a burst disc.

3. A bypass valve according to claim 2, wherein the burst disc is adapted to rupture at a second predetermined fluid pressure differential having a magnitude greater than that of the first fluid pressure differential.

4. A bypass valve according to claim 2, wherein the portion of the passage extending between the chamber and the burst disc is filled with air.

5. A bypass valve according to claim 4, wherein the air in said portion of the passage is at atmospheric pressure.

6. A bypass valve according to claim 1, wherein the cavity defined between the piston and the body is filled with air.

7. A bypass valve according to claim 6, wherein the air in the cavity is at atmospheric pressure.

8. A bypass valve according to claim 1, wherein the chamber and piston have an annular shape.

9. A bypass valve according to claim 1, wherein a spring is provided to bias the piston towards the second position.

10. A bypass valve according to claim 1, wherein the bypass valve incorporates a second piston slidably mounted in the bore and moveable between a first position in which fluid communication between the bore and the exterior of the bypass valve by means of the apertures is permitted and a second position in which fluid communication between the bore and the exterior of the bypass valve by means of the apertures is prevented.

11. A bypass valve (202) for selectively isolating the interior of a downhole assembly from the exterior thereof, the bypass valve (202) comprising: a body having a bore for allowing the passage of wellbore fluid therethrough; a chamber defined in the body; at least one first aperture (32) provided in the body for allowing fluid communication between the bore and the chamber; at least one second aperture (12) provided in the body for allowing fluid communication between the chamber and the exterior of the bypass valve; a piston (78) slidably mounted in the chamber and movable between a first position in which fluid communication between the bore and the exterior of the bypass valve by means of the apertures (32,12) is permitted and a second position in which fluid communication between the bore and the exterior of the bypass valve by means of the apertures (32,12) is prevented; a passage (92) defined in the body and extending between an opening on the exterior of the body and an opening in the chamber so as to provide, during use, fluid communication between the chamber and a wellbore in which the bypass valve is located, said opening in the chamber being located adjacent the end of the piston distal to the fluid path extending through the apertures (32,12) and between the bore and the exterior of the bypass valve; the arrangement of the piston (78) being such that, during use, wellbore fluid contacts opposing faces of the piston via said at least one second aperture (12) and said passage (92), said faces having different areas so as to generate a fluid pressure differential across the piston (78) biasing the piston towards the second position; characterised in that, the bypass valve further comprises means for controlling movement of the piston from the first position to the second position, said controlling means comprising retaining means (206) for selectively retaining the piston (78) in the first position against the bias of the fluid pressure differential, the retaining means releasing the piston in response to a predetermined fluid pressure differential so as to permit movement of the piston to the second position.

12. A bypass valve according to claim 11, wherein the retaining means is a shear pin extending between the piston and the body.

13. A bypass valve according to claim 11, wherein the chamber and piston have an annular shape.

14. A bypass valve according to claim 11, wherein a spring is provided to bias the piston towards the second position.

15. A bypass valve according to claim 11, wherein the bypass valve incorporates a second piston slidably mounted in the bore and movable between a first position in which fluid communication between the bore and the exterior of the bypass valve by means of the apertures is permitted and a second position in which fluid communication between the bore and the exterior of the bypass valve by means of the apertures is prevented.

16. A bypass valve for selectively isolating the interior of a downhole assembly from the exterior thereof, the bypass valve comprising: a body having a bore for allowing the passage of wellbore fluid therethrough; a chamber defined in the body: at least one internal aperture provided in the body for allowing fluid communication between the bore and the chamber; at least one external aperture provided in the body for allowing fluid communication between the chamber and the exterior of the bypass valve; and a piston slidably mounted in the chamber and movable between a first position in which fluid communication between the bore and the exterior of the bypass valve by means of the apertures is permitted and a second position in which fluid communication between the bore and the exterior of the bypass valve by means of the apertures is prevented, the piston being movable from the first position to the second position in response to a predetermined fluid pressure differential, wherein the or each internal aperture is located at the axially opposite end of the position to the or each external aperture; the piston comprises a passage providing fluid communication between the internal and external apertures; and retaining means is provided for selectively retaining the piston in the first position.

17. A bypass valve according to claim 16, wherein the piston is movable from the first position in a direction opposite to that in which the piston moves when moving from the first position to the second position.

18. A bypass valve according to claim 16, wherein the retaining means is a shear pin extending between the piston and the body.

19. A bypass valve according to claim 16, wherein the chamber and piston have an annular shape.

20. A bypass valve according to claim 16, wherein a spring is provided to bias the piston towards the second position.

21. A bypass valve according to claim 16, wherein the bypass valve incorporates a second piston slidably mounted in the bore and movable between a first position in which fluid communication between the bore and the exterior of the bypass valve by means of the apertures is permitted and a second position in which fluid communication between the bore and the exterior of the bypass valve by means of the apertures is prevented.

* * * * *